US010076218B2

(12) United States Patent
Bertram et al.

(10) Patent No.: US 10,076,218 B2
(45) Date of Patent: Sep. 18, 2018

(54) METHOD FOR OPERATING A VACUUM CLEANER HAVING A CYCLONE SEPARATOR AND A VACUUM CLEANER HAVING A CYCLONE SEPARATOR

(75) Inventors: Andre Bertram, Bielefeld (DE); Stefan Tiekoetter, Bielefeld (DE)

(73) Assignee: MIELE & CIE. KG, Guetersloh (DE)

( * ) Notice: Subject to any disclaimer, the term of this patent is extended or adjusted under 35 U.S.C. 154(b) by 1188 days.

(21) Appl. No.: 13/541,685

(22) Filed: Jul. 4, 2012

(65) Prior Publication Data

US 2013/0008468 A1 Jan. 10, 2013

(30) Foreign Application Priority Data

Jul. 8, 2011 (DE) ..... 10 2011 051 683

(51) Int. Cl.
*A47L 9/16* (2006.01)
*A47L 9/00* (2006.01)
*A47L 9/28* (2006.01)

(52) U.S. Cl.
CPC ..... *A47L 9/16* (2013.01); *A47L 9/0072* (2013.01); *A47L 9/2821* (2013.01); *A47L 9/2831* (2013.01); *A47L 9/2836* (2013.01)

(58) Field of Classification Search
None
See application file for complete search history.

(56) References Cited

U.S. PATENT DOCUMENTS 4,573,236 A * 3/1986 Dyson ..... 15/333
6,766,558 B1 * 7/2004 Matsumoto et al. ..... 15/353
2004/0128789 A1 * 7/2004 Harris et al. ..... 15/353
2007/0209147 A1 * 9/2007 Krebs ..... A47L 5/30 15/347
2008/0201897 A1 * 8/2008 Nakai ..... A47L 9/0477 15/339

FOREIGN PATENT DOCUMENTS

DE 29723754 U1 1/1999
DE 60201019 T2 8/2005
DE 102008038893 A1 2/2010
(Continued)

OTHER PUBLICATIONS

Machine English Translation of WO 2010/121656.*
Machine English Translation of EP2153768.*
English Machine Translation of DE102009041728.*

*Primary Examiner* — Nicole Blan
*Assistant Examiner* — Pradhuman Parihar
(74) *Attorney, Agent, or Firm* — Leydig, Voit & Mayer, Ltd.

(57) ABSTRACT

A method for operating a vacuum cleaner includes providing a vacuum cleaner including a motor-driven fan, a pick-up device configured to pick up an air-dust mixture that is disposed on a suction side of the fan, a dust separator including at least one cyclone separator and a valve element disposed between the pick-up device and the fan. The dust separator is disposed between the pick-up device and the fan. The valve element is operated so as to connect a flow path leading from the pick-up device through the at least one cyclone separator to the fan only when a predefined minimum value of a volume flow generated by the fan or a quantity correlating with the volume flow is present.

7 Claims, 4 Drawing Sheets

(56) References Cited

FOREIGN PATENT DOCUMENTS

| | | | | | |
|---|---|---|---|---|---|
| DE | 102009041728 | | * | 6/2010 | ..... A47L 5/24 |
| DE | 102009041728 | A1 | | 6/2010 | |
| EP | 1674020 | A2 | | 6/2006 | |
| EP | 2153768 | | * | 2/2010 | ..... A47L 9/10 |
| WO | WO 2010/121656 | | * | 10/2010 | ..... B01D 46/00 |

* cited by examiner

METHOD FOR OPERATING A VACUUM CLEANER HAVING A CYCLONE SEPARATOR AND A VACUUM CLEANER HAVING A CYCLONE SEPARATOR

CROSS REFERENCE TO RELATED APPLICATIONS

This application claims priority to German Patent Application No. DE 10 2011 051 683.2, filed Jul. 8, 2011, which is hereby incorporated by reference herein in its entirety.

FIELD

The invention relates to a method for operating a vacuum cleaner and a vacuum cleaner that includes a motor-driven fan, a device that picks up an air-dust mixture that is situated on the suction side of the fan, and a dust separator in the form of at least one cyclone separator.

BACKGROUND

Vacuum cleaners of the type mentioned above are generally known, for example, from European patent EP 1 674 020 B1. In such vacuum cleaners, the dust is separated by vortex formation in the air that is mixed with dust and dirt. If the centrifugal forces are sufficient, only the lighter air passes through, while the heavier dust and dirt particles remain in the collecting bin of the cyclone separator. A drawback of such separators is that the fans employed do not instantly build up the volume flow needed for the vortex formation. The centrifugal forces needed for the dust separation are thus not present right away, as a result of which, during the switch-on phase, a large quantity of the picked-up dust and dirt particles enters the cyclone and reaches the after-filters which then become clogged, and the particles might even reach the fan or exhaust air filters that are located downstream from the fan.

SUMMARY

In an embodiment, the present invention provides a method for operating a vacuum cleaner includes providing a vacuum cleaner including a motor-driven fan, a pick-up device configured to pick up an air-dust mixture that is disposed on a suction side of the fan, a dust separator including at least one cyclone separator and a valve element disposed between the pick-up device and the fan. The dust separator is disposed between the pick-up device and the fan. The valve element is operated so as to connect a flow path leading from the pick-up device through the at least one cyclone separator to the fan only when a predefined minimum value of a volume flow generated by the fan or a quantity correlating with the volume flow is present.

BRIEF DESCRIPTION OF THE DRAWINGS

Exemplary embodiments of the present invention are described in more detail below with reference to the drawings, in which.

DETAILED DESCRIPTION

Figure 1:
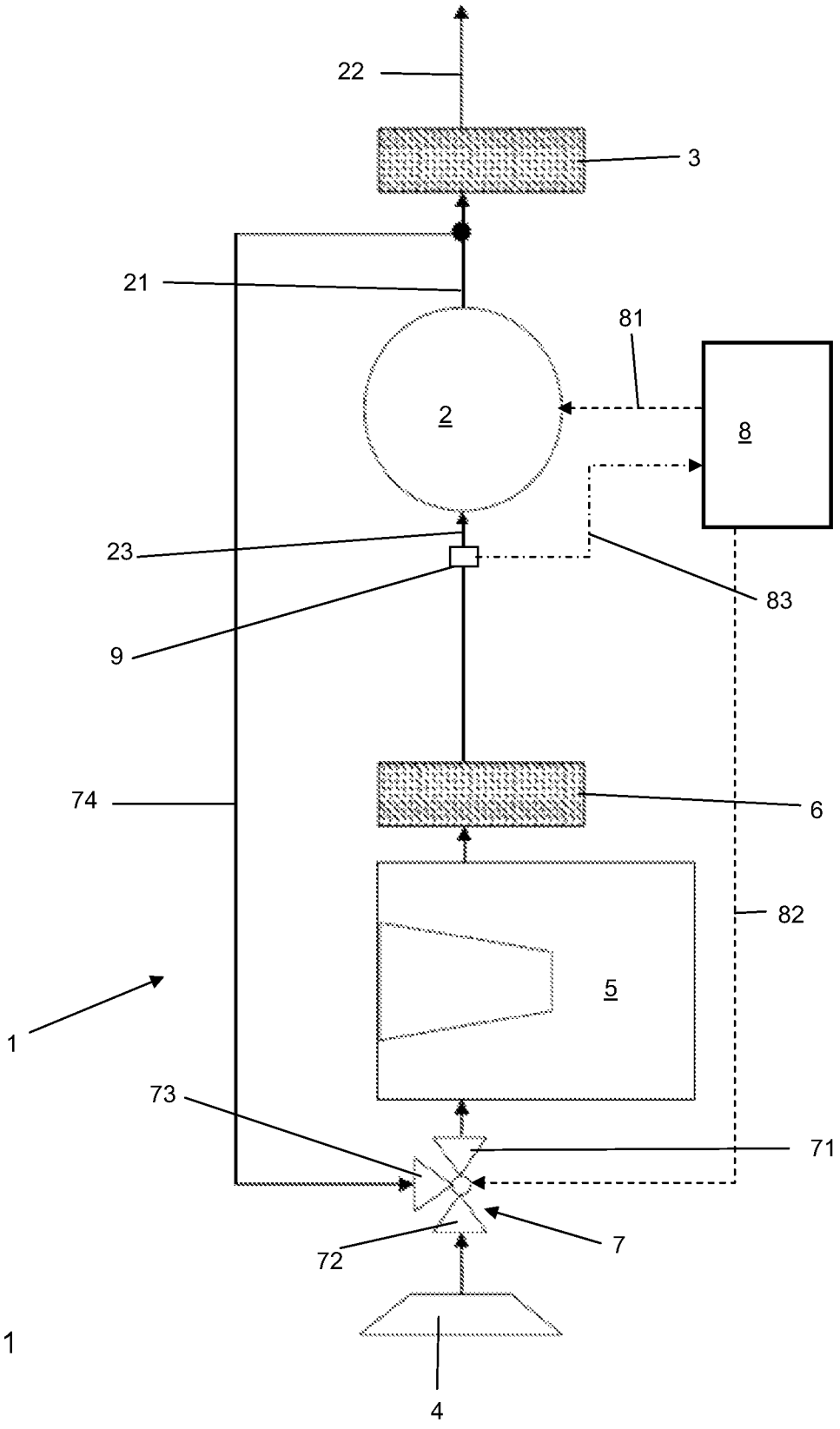
FIGS. 1 to 3 schematically show a flow path depicted in the form of a block diagram in various embodiments of a vacuum cleaner according to the invention.

An aspect of the present invention is to provide an improved method for operating a cyclone vacuum cleaner or the vacuum cleaner itself in terms of its mode of operation.

As far as the method is concerned, the advantages that can be achieved with embodiments of the invention result from the fact that at least one valve element is arranged between the pick-up device and the fan, and this valve element can connect the flow path leading from the pick-up device via the cyclone separator to the fan only once a predefined minimum value for the volume flow generated by the fan has been reached or once a quantity that correlates with the volume flow has been reached. As a result, during the switch-on phase while the fan is ramping up, the vacuum cleaner is operated with an inactive pick-up device so that suction of dust and dirt particles is prevented. As far as the device is concerned, the same advantages are attained by a vacuum cleaner in which at least one valve element is arranged between the pick-up device and the fan, and this valve element can connect the flow path leading from the pick-up device via the cyclone separator to the fan.

The fact that the minimum value has been reached can be detected by a pressure sensor arranged in the flow path between the valve element and the fan. Upper-end vacuum cleaners already have such a pressure sensor with a pressure-dependent control or regulation of the fan power, so that, aside from the valve element, no additional components are needed in order to implement the method according to the invention. Then, it is advantageous for a control unit to actuate the valve element as a function of a negative pressure value detected by the pressure sensor. The minimum negative pressure at which the cyclone separator functions properly can be determined in experiments and can be stored as an actuation criterion in the device controls.

As an alternative, the control unit can switch on the valve element once a predefined fan speed or fan motor speed has been reached. The requisite speed can likewise be determined in experiments and then stored as an actuation criterion in the device controls. Instead of the fan speed or the fan motor speed, the controls can also specify a predefined fan running time after which it can be assumed that the predefined minimum value is present. This can likewise be determined in experiments.

With less complex device controls, it is also conceivable for the valve element to automatically connect the flow path when a predefined minimum negative pressure or minimum volume flow is present, and it can be configured for example, as a spring-controlled valve element.

The valve element can advantageously be configured as a two-way valve. In a first alternative, it is arranged between the pick-up device and the cyclone separator. This advantageously ensures that a vortex already builds up in the cyclone before the pick-up device is put into operation. A drawback of this mode of operation can be seen in the fact that any residual dust still left in the collecting bin passes through the cyclone during the switch-on phase while the fan is ramping up and is deposited in the after-filter. Therefore, the user has to be instructed to empty the collecting bin each time the vacuum cleaner is used. In addition or as an alternative, the after-filter can be configured as a washable foam filter. With this variant of the valve element, a return air line should be laid from the pressure side of the fan to the valve element.

In another variant, the valve element is arranged between the cyclone and the fan. On the one hand, this entails the advantage that the air does not flow through the cyclone during the switch-on phase while the fan is ramping up, so that no dirt from the collecting bin is swirled up. On the other hand, a return air line is not absolutely necessary, so that the valve element can be also be connected via a bypass to the ambient air of the vacuum cleaner, as a result of which relatively clean outside air is drawn in. A drawback here can be seen in the fact that the cyclone is only supplied with suction air after the valve element has been switched over. However, it can be assumed that, once the fan has ramped up, the air vortices needed for the centrifugal separation will build up instantly and the amount of dust and dirt particles that passes through the cyclone will be very small.

Figure 2:
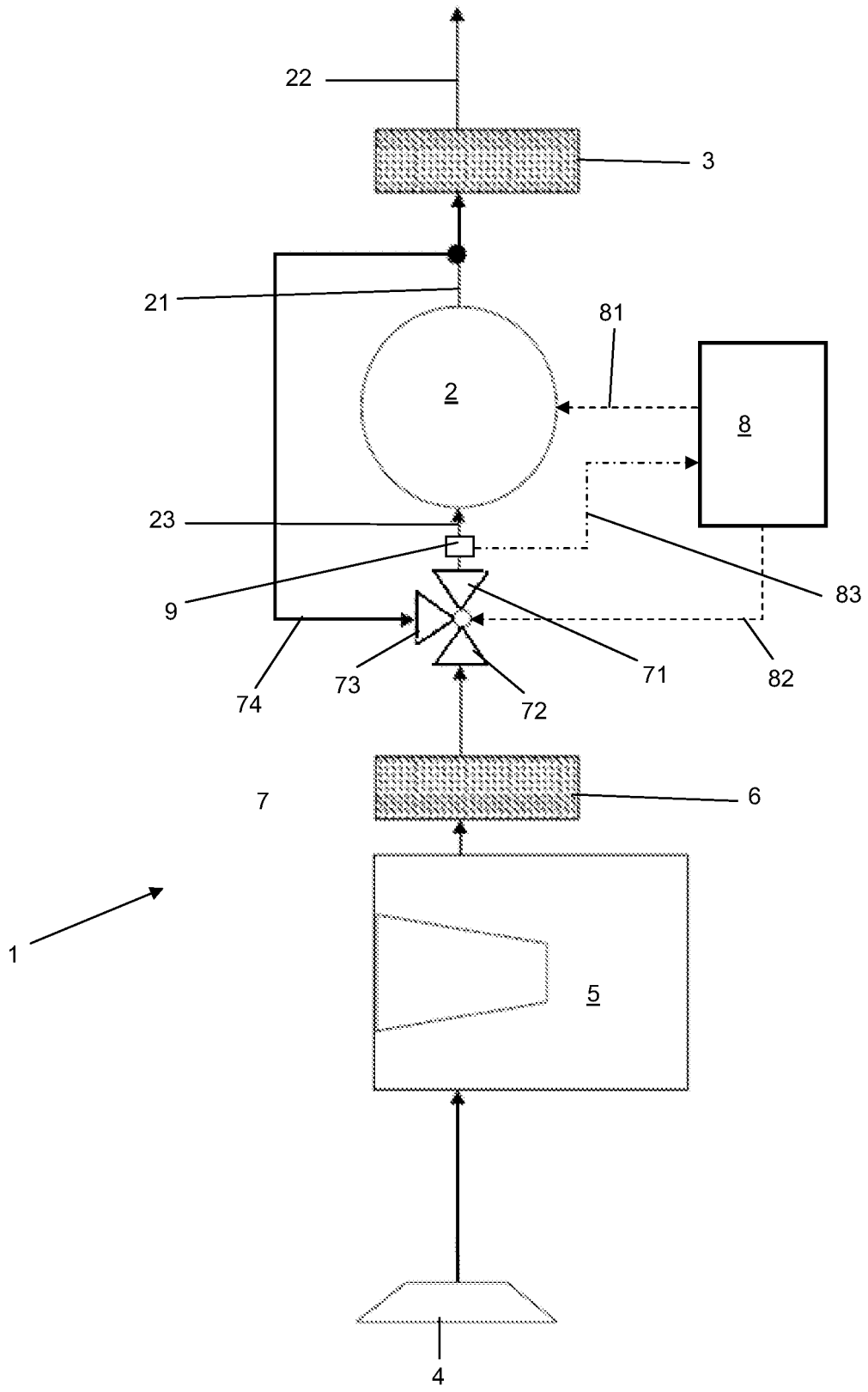
Figure 3:
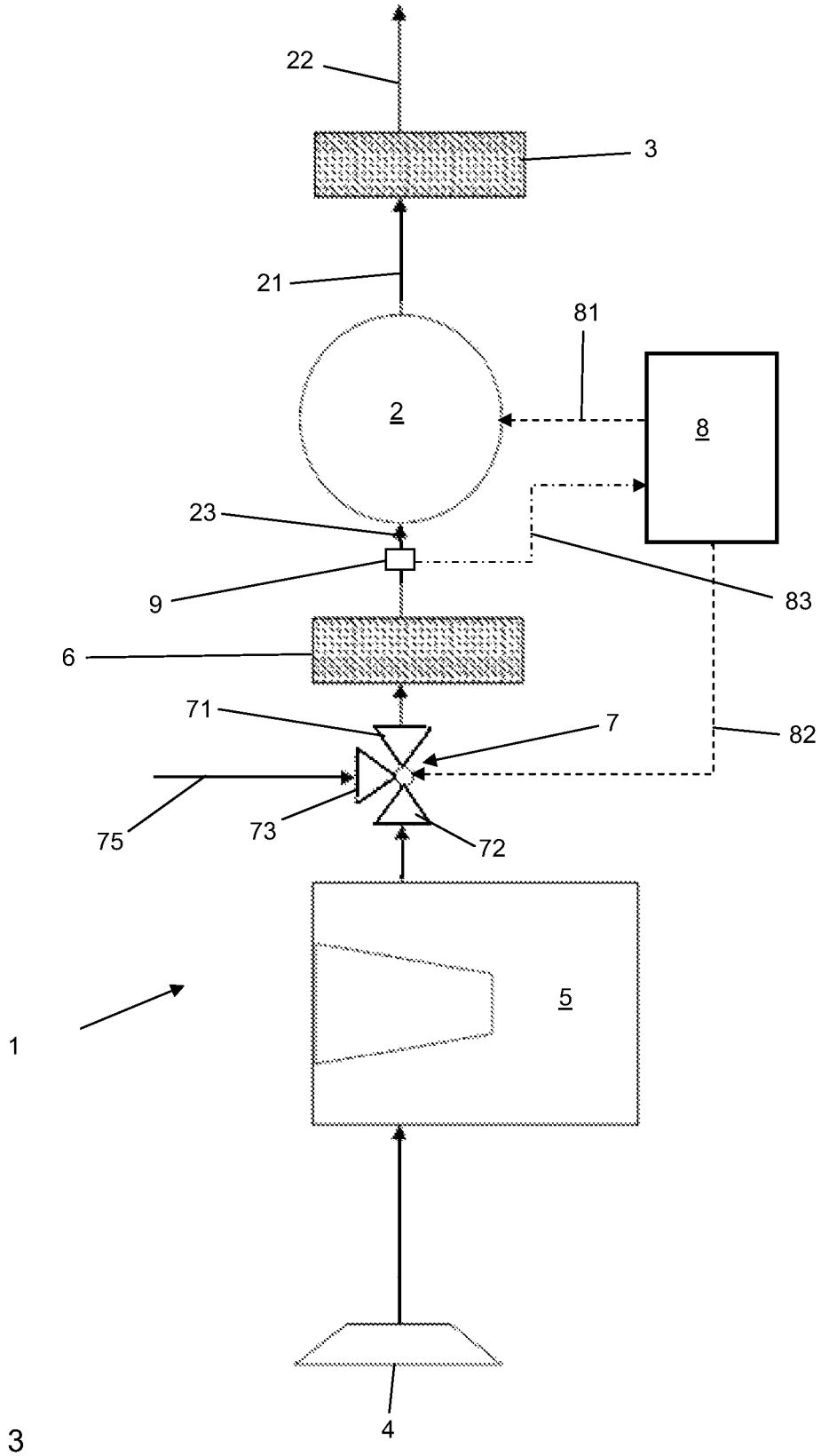

FIGS. 1 to 3 show various alternatives of cyclone vacuum cleaners according to the invention. The components needed to convey the air are depicted in the form of a block diagram. The vacuum cleaner itself is designated with the reference numeral 1. It is equipped with a motor-driven fan in a generally known manner. The fan aggregate and the drive motor are depicted here as a unit by the circle 2 and are referred to below as the fan 2. The fan 2 blows air 22 on the pressure side 21 via an exhaust air filter 3 out of the vacuum cleaner housing. As a result, a negative pressure is generated on the suction side 23 of the fan 2 that ensures that a suction air flow is generated. This air flow enters the flow path of the vacuum cleaner 1 at a pick-up device 4, picking up dust and dirt particles in the process. The pick-up device 4 is generally adapted to the substrate that is to be treated, and can be a suction nozzle, a turbo-brush or an electric brush, a furniture brush, a crevice tool or a suction attachment shaped in some other fashion, or else a suction tube or a suction hose with which one of the above-mentioned suction attachments can be connected to the device housing. There, the pick-up device 4 is connected via an appropriate flow path to a cyclone separator 5. Optionally, an after-filter 6 is arranged in the further flow path between the cyclone separator 5 and the fan. Moreover, according to the invention, a valve arrangement—here in the form of a two-way valve 7—is situated at a suitable place between the pick-up device 4 and the fan.

In the variant shown in FIG. 1, the valve 7 is positioned between the pick-up device 4 and the cyclone separator 5. A suitable installation site in a floor-model vacuum cleaner is the air passage between the suction hose connector and the cyclone separator 5. The outlet side 71 of the valve 7 is connected to the further flow path leading to the fan 2, thus here the flow path to the cyclone separator 5. An inlet side 72 is flow-connected to the pick-up device 4, and another inlet side 73 is connected via a return air line 74 on the pressure side 21 of the fan 2. Due to the design as a two-way valve, the flow path can be connected as desired from one of the inlet sides 72 or 73 to the outlet side 71. The vacuum cleaner 1 also has a device control unit 8, preferably in the form of a microprocessor control unit. From there, a control line 81 leads to the fan 2 while a control line 82 leads to the valve 7, and also a data line 83 leads to a pressure sensor 9 between the valve 7 and the cyclone separator 5. Instead of the pressure sensor 9, a volume flow sensor can be present upstream from the fan 5 or a speed sensor can be present on the fan motor. A spring-controlled two-way valve 7 can also be used instead of the externally controlled valve 7 which can then be configured as an electromagnetically actuated valve 7. In this case, the control line 82 is not needed.

In the variant according to FIG. 2, the two-way valve 7 is arranged between the filter 6 and the fan 2. The outlet side 71 of the valve 7 is connected directly to the fan 2, the inlet side 72 is connected to the flow path downstream from the after-filter 6, and the inlet side 73 is once again connected via a return air line 74 to the pressure side 21 of the fan 2.

The embodiment according to FIG. 3 has a two-way valve 7 that is arranged between the cyclone separator 5 and the after-filter 6. The outlet side 71 of the valve 7 is connected to the flow path downstream from the after-filter 6, the inlet side 72 is connected to the outlet of the cyclone separator 5, and the inlet side 73 here is not connected to a return air line 74 but rather to a bypass 75 that draws in ambient air through an opening in the vacuum cleaner housing. Such a bypass 75 instead of a return air line 74 would also be conceivable for the variant according to FIG. 2.

Figure 4:
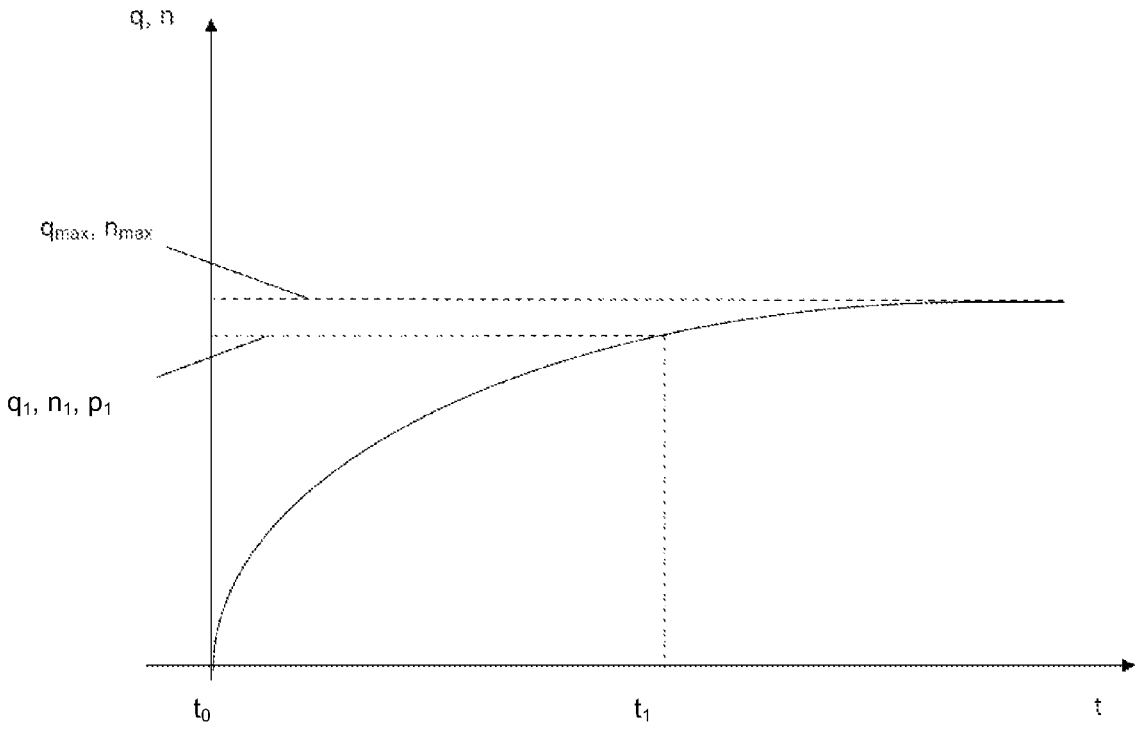
FIG. 4 shows a time-dependent curve of the fan speed and of the volume flow during the switch-on procedure of a vacuum cleaner fan.

FIG. 4 shows a diagram in which the time-dependent curve of the fan speed or motor speed n and of the volume flow q is depicted when the fan 2 of FIGS. 1 to 3 is switched on. It can be seen that, after the fan 2 has been switched on at the point in time to, the speed n as well as the volume flow q rise and asymptotically approach a value nmax or qmax. The curve of the negative pressure that is generated on the suction side 23 of the fan 2 is dependent on the cross sections of openings in the flow path such as those formed, for example, by different pick-up devices 4. In the considerations below, it can be assumed that, when the fan 2 is switched on, according to the invention, the valve 7 is in a position in which the inlet 72 is closed and the inlet 73 is open and connected to the outlet 71. Consequently, no changes in the cross sections occur within the flow path and it can be assumed that the pressure proportionally follows the volume flow and the speed. As already described above, the fan 2 cannot instantly build up the volume flow in the cyclone separator 5 that is needed for the vortex formation. This can also be seen in FIG. 4. The centrifugal forces needed for the dust separation are thus not immediately present. It can now be determined in experiments at which volume flow the dust separation in each individual cyclone separator is sufficient. A time t1, a volume flow q1, a speed n1 or a negative pressure p1 can be associated with this event. It is sufficient to determine one of these parameters and, only once one of these parameters has been reached, to switch over the valve 7 in such a way that now the inlet 72 is open and the inlet 73 is closed. Then it becomes possible for the pick-up device 4 to pick up dust.

The cited parameters can be determined via suitable sensors, for example, by means of the described pressure sensor 9, and the valve 7 can then be actuated by the control unit 8. As an alternative, it is possible to detect the pressure p1 or the volume flow q1 by means of a spring mechanism that is integrated into the valve 7, and to actuate the valve 7 automatically and independently of the device control unit 8.

In the case of a cyclone separator 5 that is designed to achieve a high level of separation, it is optionally possible to dispense with the second filter 6. Then, however, the use of an exhaust air filter 3 is advantageous.

While the invention has been particularly shown and described with reference to preferred embodiments thereof, it will be understood by those skilled in the art that various changes in form and details may be made therein without departing from the spirit and scope of the invention.

What is claimed is:

1. A method for operating a vacuum cleaner, the method comprising:

providing a vacuum cleaner including:

a motor-driven fan;

a pick-up device configured to pick up an air-dust mixture that is disposed on a suction side of the fan;

a dust separator including at least one cyclone separator, the dust separator being disposed between the pick-up device and the fan;

a valve element disposed between the pick-up device and the fan, the valve element including a first inlet side connected to the pick-up device, a second inlet side connected to a return air line on a pressure side of the fan, and an outlet side connected to a flow path leading to the fan;

a pressure sensor disposed between the outlet side of the valve element and the fan; and a control unit configured to actuate the valve element, the control unit including a first control line connected to the fan, a second control line connected to the valve element, and a data line connected to the pressure sensor, detecting, using the pressure sensor, a predefined minimum value of a volume flow generated by the fan or a quantity correlating with the volume flow; and operating the valve element, using the control unit, between a first position in which the first inlet side is closed and the second inlet side is open and connected to the outlet side, and a second position in which the first inlet side is open and connected to the outlet side and the second inlet side is closed so as to connect a flow path leading from the pick-up device through the at least one cyclone separator to the fan only when the predefined minimum value is present.

2. The method recited in claim 1, wherein the dust separator includes an after-filter.

3. The method recited in claim 1, wherein the control unit is configured to actuate the valve element as a function of a negative pressure value detected by the pressure sensor.

4. The method recited in claim 1, wherein the control unit is configured to switch the valve element when at least one of a predefined fan speed and a predefined motor speed has been reached.

5. The method recited in claim 1, wherein the control unit is configured to switch the valve element after a predefined fan running time, the running time being selected so as to allow sufficient time to elapse for the predefined minimum value to be present.

6. The method recited in claim 1, wherein the valve element automatically opens the flow path leading from the pick-up device through the at least one cyclone separator to the fan when at least one of a predefined minimum negative pressure and a predefined minimum volume flow is present.

7. The method recited in claim 6, wherein the valve element includes a spring-controlled configuration so as to connect the flow path leading from the pick-up device through the at least one cyclone separator to the fan.

* * * * *